US005349320A

United States Patent [19]

Suzuki et al.

[11] Patent Number: 5,349,320

[45] Date of Patent: Sep. 20, 1994

[54] IGNITION COIL FOR INTERNAL COMBUSTION ENGINES

[75] Inventors: Nobuo Suzuki; Koji Yoshikawa; Hitoshi Takeuchi, all of Oobu, Japan

[73] Assignee: Aisan Kogyo Kabushiki Kaisha, Aichi, Japan

[21] Appl. No.: 108,058

[22] Filed: Aug. 17, 1993

[30] Foreign Application Priority Data

Aug. 27, 1992 [JP] Japan ..... 4-252235

[51] Int. Cl.[5] ..... H01F 27/02; H01F 27/30

[52] U.S. Cl. ..... 336/92; 336/96; 336/107; 336/110; 336/198

[58] Field of Search ..... 336/92, 90, 96, 105, 336/107, 192, 110, 198, 208, 212; 123/634

[56] References Cited

U.S. PATENT DOCUMENTS

| | | | |
|---|---|---|---|
| 4,843,362 | 6/1989 | Heritier-Best | 336/92 |
| 4,926,152 | 5/1990 | Ito et al. | 336/96 |
| 5,041,807 | 8/1991 | Badaud | 336/192 |

FOREIGN PATENT DOCUMENTS

| | | |
|---|---|---|
| 2-13720 | 1/1990 | Japan . |
| 2-35429 | 3/1990 | Japan . |

*Primary Examiner*—Thomas J. Kozma
*Attorney, Agent, or Firm*—Koda and Androlia

[57] ABSTRACT

An ignition coil for internal combustion engines including a primary core formed in a shape of rectangular ring and fixed on the inner peripheral edge of the bottom wall of a casing, a secondary core having a main portion of which is formed in a shape of straight beam, a primary winding assembly having a primary bobbin formed on the main portion of the secondary core, and a secondary winding assembly. Both winding assemblies are housed in an internal space of the casing, and a synthetic resin is filled in the internal space of the casing and cured. In the side wall of the casing is formed a rectangular opening portion which opens at the top end; and on the primary bobbin a rectangular closing member is formed integrally therewith. When the opening portion of the casing is closed with the closing member, both end faces in the longitudinal direction of the secondary core formed in the primary bobbin face to the inside peripheral surfaces of the primary core. A permanent magnet with its one face in contact with one end face of the secondary core is supported on the primary bobbin, while the other face of the permanent magnet is in contact with the primary core.

7 Claims, 7 Drawing Sheets

IGNITION COIL FOR INTERNAL COMBUSTION ENGINES

BACKGROUND OF THE INVENTION

1. Field of the Invention

The present invention relates to an ignition coil for internal combustion engines and, more particularly, to an ignition coil holding a core, a primary winding and a secondary winding in a casing.

2. Description of the Prior Art

An ignition coil for internal combustion engines generally has primary and secondary windings wound concentrically with each other. The starting end of winding of a wire forming the primary winding is electrically connected to a positive side of a battery, and the terminal end of winding of the wire is also electrically connected to a negative side of the battery through a control circuit. The starting end of a wire used as the secondary winding is electrically connected to spark plugs of the internal combustion engine, while the terminal end thereof is electrically connected to the starting end of the primary winding.

Each end of the wires forming the primary and secondary windings is electrically connected to one of plurality of terminals, respectively, protrusively provided on a bobbin for winding the primary winding, a bobbin for winding the secondary winding, and/or on a casing. Each of these terminals is connected to the battery, the control circuit, and the spark plugs.

In the Japanese Utility Model Registration Application Laid-Open Gazette No. 2-13720 issued January, 1990, has been disclosed an ignition coil of such a construction that a coil assembly with primary and secondary windings coaxially wound on the outer periphery of a primary cylindrical bobbin having a square cross section is inserted in a casing produced of an insulating synthetic resin, and then after filling of an insulating synthetic resin in the casing to set the primary and secondary winding with the resin thus filled, a couple of cores formed in the U shape are installed with their legs on one side inserted into a hollow portion of the primary bobbin through each of openings formed on the casing, oppositely from both ends of the bobbin, and with the free ends of their other legs secured by welding on the exterior of the casing. This ignition coil, however, apts to rust readily because the core forming a closed magnetic circuit is partly exposed outside of the casing.

Also disclosed in the Japanese Utility Model Registration Application Laid-Open Gazette No. 2-35429 issued March, 1990, is a process which includes the steps of inserting, into a coil casing, a coil assembly in which a secondary bobbin wound with a secondary winding is retained coaxially on the outer periphery of a primary bobbin wound with a primary winding, protruding the free ends of the legs of a U-shaped core having two legs of the same length out of the exterior of the coil casing, with one of the legs exposed out of the coil casing and with the other legs of the core inserted in the hollow portion of the primary core, fixing the core of small volume to one of the two legs of the core, and then molding the casing portion to be connected to the coil casing and at the same time covering the core portion exposed out of the coil casing. According to the above-noted disclosure, it is difficult to mold the casing portion and therefore is difficult, owing to its construction, to support the terminals on the casing portion.

SUMMARY OF THE INVENTION

It is a primary object of the present invention to provide an ignition coil for internal combustion engines which can be readily assembled and mounted on the internal combustion engine, in which winding assemblies housed in an internal cavity of a casing has a core which forms a closed magnetic circuit and being divided into a primary core and a secondary core, the primary core being fixed in the internal cavity of the casing, and a core assembly including the secondary core having a primary and secondary windings wound thereon being housed in an internal cavity of a casing.

It is another object of the present invention to provide an easy-to-install ignition coil in which the coil assembly is divided into a primary bobbin assembly having a primary winding wound on a primary bobbin which is formed on the outer periphery of a secondary core and a secondary bobbin assembly having a secondary winding wound on a secondary bobbin which is so formed as to enclose the primary bobbin and the primary winding whereby fabrication of the primary and secondary bobbin assemblies are separately done; and the primary and secondary windings are electrically connected to a circuit to be connected to the ignition coil, and are installed in the internal cavity of the casing.

It is a further object of the present invention to provide an ignition coil for internal combustion engines in which the primary core is formed in a shape of square ring in a plan view, while a main portion of the secondary core is formed in a shape of straight beam so that end faces of the secondary core may contact with the two opposite sides of the primary core; and a permanent magnet is placed between the secondary core and the primary core at one end portion where the secondary core contacts the primary core to thereby increase a change in the magnetic flux produced at the secondary winding.

It is a still further object of the present invention to provide a compact ignition coil having good electrical insulation between portions composing the ignition coil, in which primary and secondary winding assemblies are embedded in an insulating synthetic resin portion filled and hardened in the internal space of a casing through a first opening of the casing.

According to the present invention, the ignition coil for internal combustion engines has a constitution described below.

In the ignition coil, a core constituting a magnetic circuit is divided into a primary core and a secondary core; a casing of the ignition coil formed of an insulating synthetic resin is of a box type, which has a bottom wall provided with a step portion formed on an inside wall surface for fixing the primary core, a side wall formed in a tubular form surrounding the bottom wall, and a first opening portion surrounded with the edge of the free end of the side wall. The primary core is preferably formed like a square ring in a plan view, and is secured to the step portion formed on the bottom wall of the casing. The primary core can be fixed to the step portion by an insert resin molding process at the time of molding of the casing.

The secondary core, together with the primary core, forms the closed magnetic circuit, in which a core main portion of the secondary core is formed in a shape of straight beam and the end faces at the end of the secondary core located at both ends in the longitudinal direction of the core main portion are held in contact with the primary core. Where the primary core is formed in the shape of square ring, the end faces at both ends of the secondary core are in contact with two sides of the primary core at inner side surfaces thereof facing with each other. On the secondary core, a primary bobbin including a bobbin main portion covering the side peripheral surface of the core main portion and a holding portion formed integrally with and on one side of the bobbin main portion is formed out of an insulating synthetic resin. At one or both ends in the longitudinal direction of the primary bobbin, an extended connecting portion extended from the bobbin main portion to the upper surface of the primary core is formed integrally with the bobbin main portion in a position offset relative to the bobbin main portion. On the outer peripheral surface of the bobbin main portion is wound with a primary windings. Both ends of a insulated wire composing the primary winding are electrically connected respectively to conductive first and second terminals which are protrusively provided at one of the extended connecting portions of the primary bobbin. As noted heretofore, the primary winding assembly is fabricated. The secondary core is preferably secured to the primary bobbin by the insert resin molding process at the time of molding of the primary bobbin.

A secondary bobbin is formed of an insulating synthetic resin and into a tubular form, which encloses the outer periphery of the primary bobbin and the primary winding of the primary winding assembly. On the outer periphery of the secondary bobbin is wound with the secondary winding; one end of an insulated wire composing the secondary winding is electrically connected to a conductive auxiliary terminal protrusively provided on the secondary bobbin, while the other end of the insulated wire is connected to a conductive lead member provided on the secondary bobbin protrusively and perpendicularly to the axial direction of the secondary bobbin. As noted heretofore, the secondary winding assembly is fabricated. Said auxiliary terminal provided on the secondary winding assembly is electrically connected to the first terminal provided on the primary bobbin, after the bobbin main portion of the primary bobbin is inserted into the hollow portion of the secondary bobbin. In the winding assembly thus assembled, the primary winding of the primary winding assembly is installed coaxially with the secondary winding of the secondary winding assembly.

The winding assembly described above is inserted into the internal space of the casing through the first opening portion of the casing. At this time, the extended connecting portion extendingly positioned at one end of the bobbin main portion of the primary bobbin is mounted on the upper surface of the primary core fixed in the casing, and then, at both ends in the longitudinal direction of the secondary core, the end face portions of the secondary core which are not covered by the primary bobbin are held in contact with the inner side surfaces of the primary core, and the secondary core is set in a position where the secondary core, together with the primary core, constitutes the closed magnetic circuit. In the bottom wall of the casing is formed a second opening portion at the time of molding; on the inside wall of the second opening portion is fixed a conductive terminal member to chose the second opening portion with its outer peripheral surface. It is preferable that the terminal member be fixed by the insert resin molding process at the time of molding of the casing. This terminal member has a center hole; when the coil assembly is inserted into the internal space of the casing, the lead member extending perpendicularly to the axial direction of the secondary bobbin is received into the center hole. The lead member is electrically connected by soldering to the terminal member after determining relative positions of the primary and secondary cores.

According to a preferred embodiment of the present invention, a plate-like permanent magnet is supported on a supporting portion of the primary bobbin constituting the primary winding assembly. This permanent magnet is supported by the primary bobbin such that its one side surface is contacted with one end face of the secondary core located in a position facing to the primary core. After the insertion of the winding assembly in the casing, the other side surface of the permanent magnet is held in contact with the inside surface of one side of the primary core. This permanent magnet is magnetized so that its one surface coming in contact with the primary core and the other surface coming in contact with the secondary core will become poles having different magnetic polarities, to thereby increase a change in the effective flux produced around the primary and secondary cores. Therefore it is possible to increase the flux density formed within the primary winding in relation to a magnetomotive force produced by the supply of the primary current and the discharge energy and the output voltage of the secondary coil as well.

In the ignition coil according to the present invention, during use of the ignition coil, the terminal member fixed on the casing in the second opening portion is connected to spark plugs of the internal combustion engine; the first terminal provide on the primary bobbin of the primary winding assembly is connected to a power battery of the ignition circuit for the spark plugs; and the second terminal is connected to the control circuit of the ignition circuit.

An insulating synthetic resin such as epoxy resin, etc. is filled in a fluid state into the internal space of the casing through the first opening portion and formed a synthetic resin portion after hardened for the purpose of fixing the primary and secondary winding assemblies much firmer to the casing. The synthetic resin filled in the hollow portion of the secondary bobbin forms a synthetic resin portion, connecting the primary bobbin and the primary winding, together with the secondary core, to the secondary bobbin. Also the synthetic resin portion filled and set around the secondary winding wound on the secondary bobbin ensures to reliably and firmly fix the winding assemblies to the casing.

According to a further preferred embodiment of the present invention, a third opening portion which opens at the free end of the side wall is formed in a portion of the side wall of the casing; and in the primary winding assembly, a closing member and a connector portion having the conductive third and fourth terminals at an outside surface of the closing member are formed integrally with the primary bobbin. The closing member is so shaped as to close the third opening portion, and the closing member and the connector portion are integrally connected with the extended connecting portion of the primary bobbin. The above-mentioned closing member serves to guide the secondary core supported on the primary bobbin to the position where the secondary core be properly positioned with respect to the first core which is fixed on the casing when the winding assemblies are mounted to the third opening portion of the casing. The third and fourth terminals protrusively provided on the connector portion are electrically connected to the first and second terminals, respectively, by means of conductors embedded in the closing member and the connecting portion; and during the use of the ignition coil the third terminal is connected to the battery and the fourth terminal is connected to the control circuit, respectively, to thereby facilitate the connection of the ignition coil to the electric circuit.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding portions through the several views and wherein.

DESCRIPTION OF THE PREFERRED EMBODIMENTS

Figure 1:
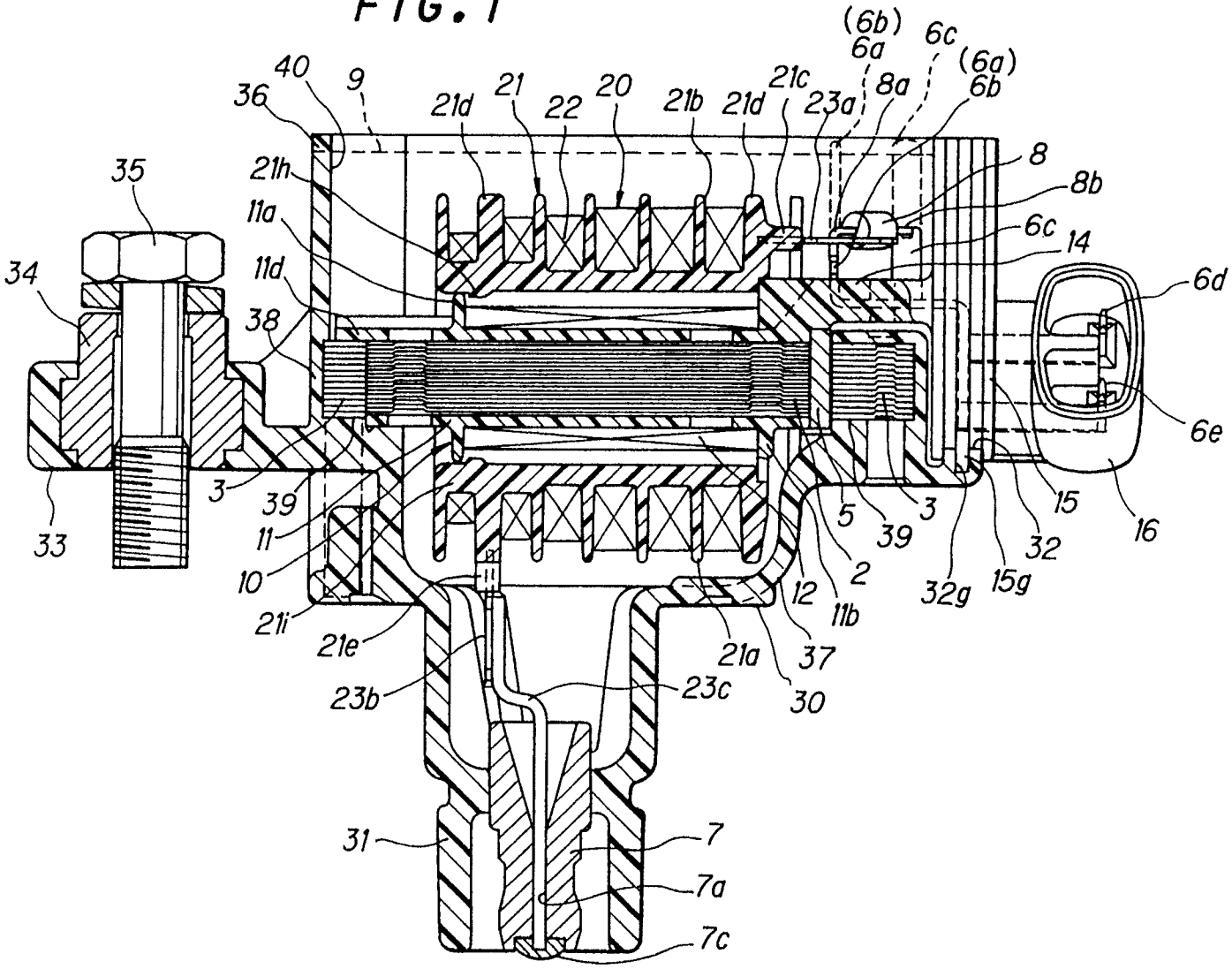
FIG. 1 is a sectional view of one embodiment of an ignition coil according to the present invention taken along the vertical plane of the ignition coil before the filling of resin in a casing.
Figure 2:
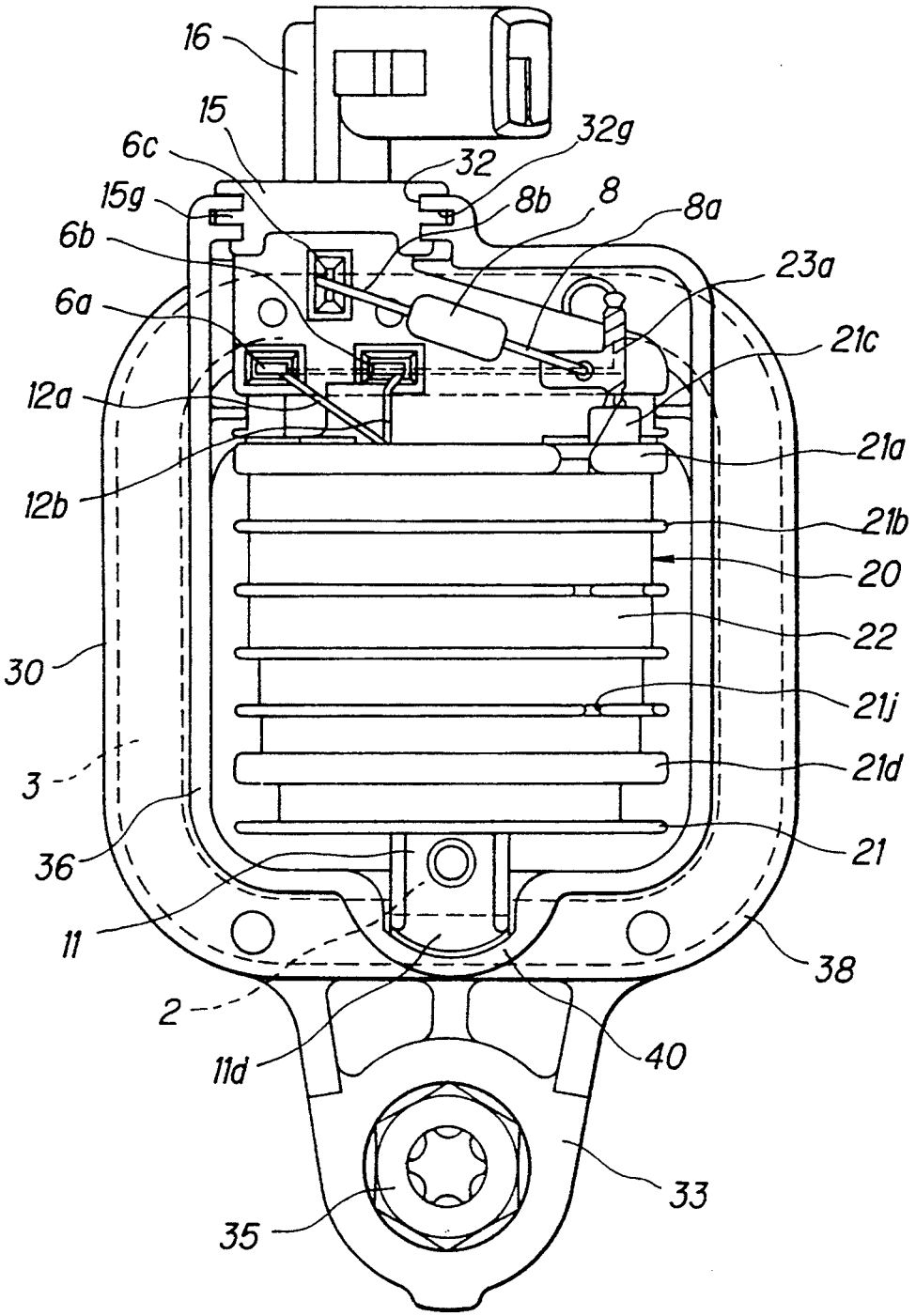
FIG. 2 is a plan view of the ignition coil in the aforesaid embodiment before the filling of the resin in the casing.
Figure 3:
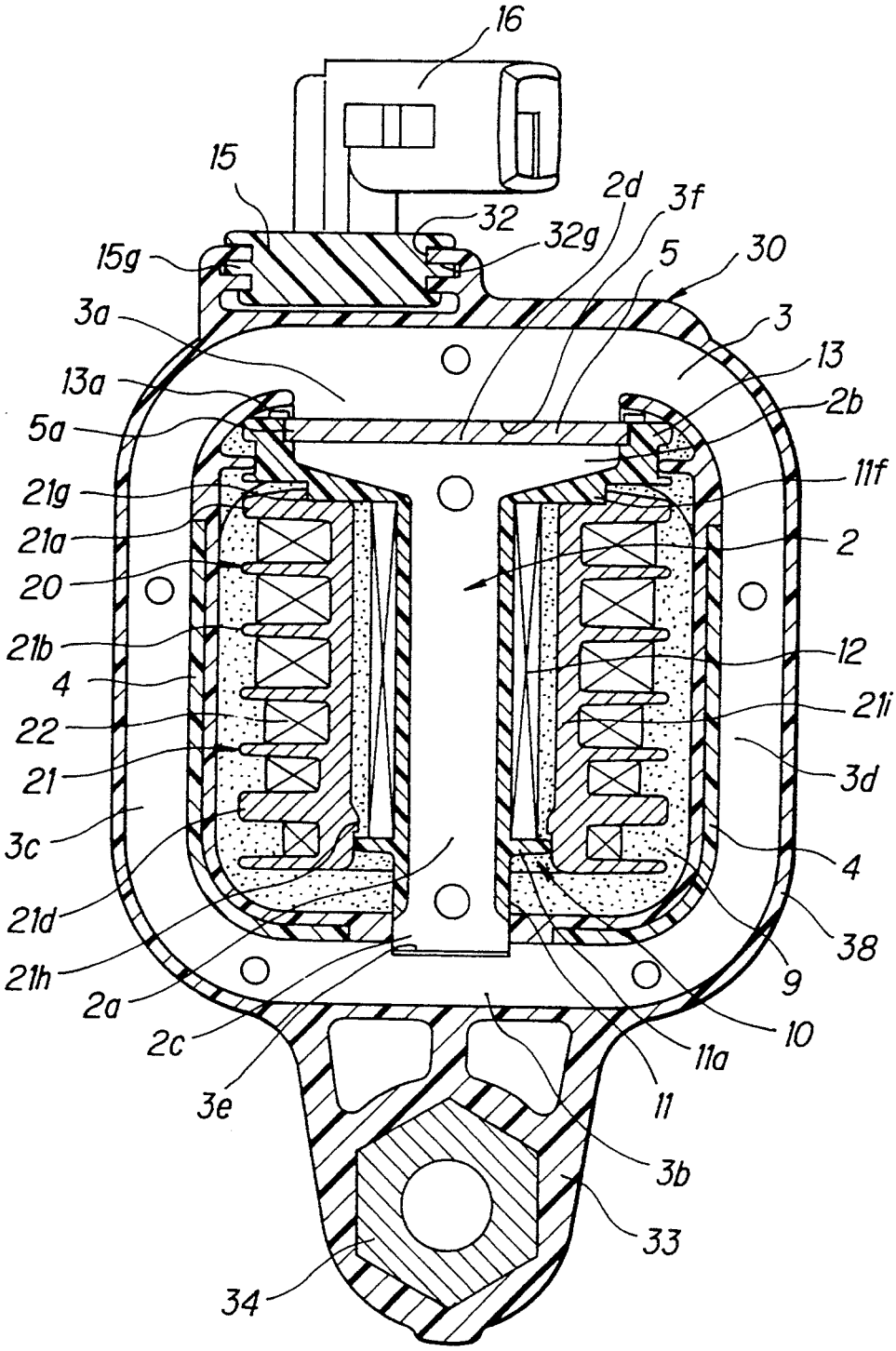
FIG. 3 is a sectional view of the ignition coil in the aforesaid embodiment taken along its horizontal plane after the formation of a synthetic resin portion of the resin filled in the casing.

Generally speaking, the ignition coil for internal combustion engines in accordance with the present invention comprises, as shown in FIGS. 1 to 3, a casing 30 molded out of a synthetic resin; a primary core 3 produced of a layered product of silicon steel sheet in a shape of a nearly square ring; a primary winding assembly 10 including a secondary core 2 produced of a layered product of silicon steel sheet in a shape of nearly straight beam, a primary bobbin 11 formed on the side peripheral surface of the core 2, and a primary winding 12 wound on the outer peripheral surface of the primary bobbin 11, in which the secondary core 2 is inserted in the primary core 3 with the both ends in the longitudinal direction of the secondary core 2 set facing directly against a portion of the inner peripheral surface of the primary core 3; and a secondary winding assembly 20 including a secondary bobbin 21 coaxially installed on the outer periphery of the primary winding 12 and a secondary winding 22 wound on the outer periphery of the secondary bobbin 21, in which the secondary winding assembly 21 is installed in a space formed in the primary core 3. When the supply of the primary current being supplied to the primary winding 12 of the ignition coil is interrupted, there occurs a change in the flux in the primary core 3 and the secondary core 2, resulting in induction of a counter electromotive force at the secondary winding 22 to thereby produce a high voltage. The spark plug of an internal combustion engine (not illustrated), When applied with a high voltage, generates an electric spark between electrodes at the tip end thereof.

Figure 10:
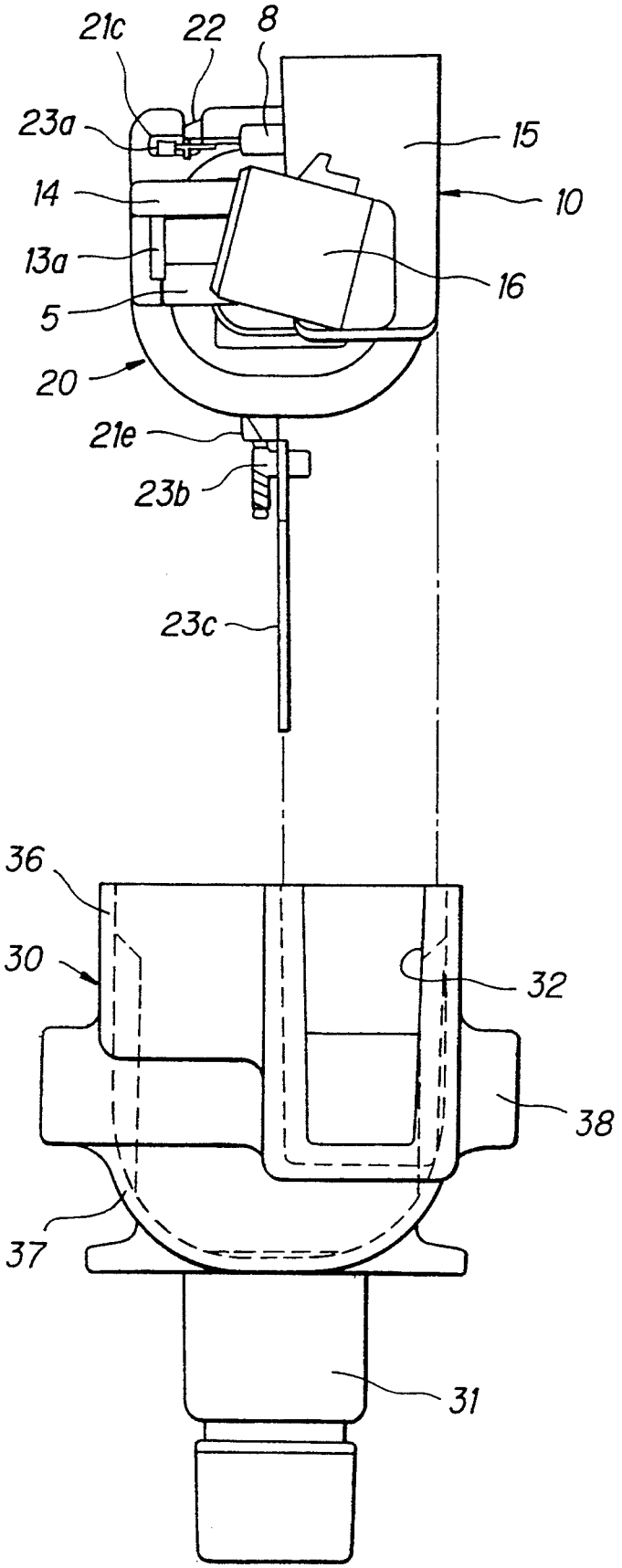
FIG. 10 is a side view of the aforesaid embodiment of the ignition coil in which the primary and secondary winding assemblies are to be mounted in the casing.

The casing 30 is formed by die molding out of a synthetic resin into a box type casing. As shown in FIGS. 1 to 3 and 10, the casing 30 has a first opening portion in a face of the casing 30 which face is positioned on the upper side of the casing 30 when the casing 30 is installed on the internal combustion engine, on a peripheral equipment of the internal combustion engine, or on an upper surface of a vehicle body on which the internal combustion engine is mounted. The casing 30 integrally comprises a side wall 36 having a shape of nearly square cylinder, a bottom wall 37 having a shape of semi-cylinder which is formed on the same axis as the secondary bobbin 21 of the secondary winding assembly 20 at the bottom portion of the casing, a secondary connector portion 31 having a shape of cylinder for forming a second opening portion and vertically protruding nearly at the central portion of the bottom wall 37, an enlarged side wall portion 38 having an enlarged outer periphery than the side wall 36 and locating between the side wall 36 and the bottom wall 37, and a seat portion 33 vertically protruding at one side edge of the side wall 36 outside of the enlarged side wall portion 38 (FIGS. 1 and 10). Said first opening portion is surrounded by free top edge portions of the side wall 36. In the casing 30 has an internal space which is surrounded with the inner peripheral surfaces of the side wall 36, the enlarged side wall portion 38 and the bottom wall 37, and which is communicating with the second opening portion of the cylindrical secondary connector portion 31 to the first opening portion of the side wall 36. Said first opening portion is large enough to insert the secondary winding assembly 20 into said internal space. Furthermore, on the inner peripheral surface of the enlarged side wall portion 38 which defines the internal space, a step portion 39 having the same shape as the bottom surface of the primary core 3 is provided within a horizontal plane, at a boundary between the enlarged side wall portion 38 and the bottom wall 37, for mounting and bonding the lower surface of the primary core 3. In the embodiment illustrated, a third opening portion 32 having a shape of a rectangle and opening at the edge portion of the first opening portion is formed in one side of the side wall 36 located oppositely to the one side of the side wall 36 adjacent to the seat portion 33 of the casing 30.

The primary core 3 is a laminated member consisting of a plurality of silicon steel core plates made by punching a silicon steel sheet into a form of square ring. The shape of each core in a plan view is such that, as shown in FIG. 3, four side portions 3*a*, 3*b*, 3*c* and 3*d* having the same width are smoothly connected, using a circular arc, at four corner portions connecting these four side portions. In a space surrounded by the inner peripheral surface of the four side portions 3*a*, 3*b*, 3*c* and 3*d* of the primary core 3, the secondary coil assembly 20 is installed. The secondary core 2 included in the secondary winding assembly 20 is of such a construction that its core main portion *2a* having a shape of a beam is positioned in parallel with the two side portions *3c* and *3d* facing with each other of the primary core 3 while both ends in the longitudinal direction of the secondary core 2 are faced against the inner peripheral surfaces of two side portions *3a* and *3b* facing with each other of the main portion *2a*, whereby the primary core 3 and the secondary core 2 constituting the magnetic circuit of the ignition coil. Of the two side portions *3a* and *3b* facing each other of the primary core 3, one side portion *3a* is enlarged in width inward of the primary core 3; a straight edge portion *3f* which is extending perpendicular to the longitudinal direction of the core main portion *2a* of the secondary core 2 is formed on the inner peripheral edge; the other side portion *3b* is provided with a recess *3e* nearly at the center of the inner peripheral surface in which one end of the core main portion *2a* of the secondary core 2 is fitted. Each core plate of the primary core 3 previously stated may be formed of a grain oriented silicon steel sheet.

The primary core 3 is fixed inside the casing 30 with its outer peripheral edge held contact with the inner peripheral surface of the enlarged side wall portion 38 of the casing 30 and with its lower surface in contact with the step portion 39 provided around the inner peripheral surface of a boundary portion between the enlarged side wall portion 38 and the bottom wall 37. Concretely speaking, the primary core 3 is supported with a mold for forming the inner peripheral surface of the casing 30 and fixed to the casing 30 by the insert resin molding process at the time of molding of the casing 30, the step portion being formed at the time of molding of the casing 30. The inner peripheral surface of each of the side portions *3a*, *3b*, *3c* and *3d* of the primary core 3 is exposed out into the interior space in the casing molded by the insert resin molding. The primary core 3 is covered with a layer 4 of an elastic material such as elastomer partly or over the entire surface of the inner peripheral surface of each side portion except the inner peripheral surface of the straight edge portion *3f* of the side portion *3a* and the inner peripheral surface of the recess *3e* of the side portion *3b*. Forming this layer 4 of the elastic material can absorb a thermal expansion difference between the primary core 3 and the casing 30 surrounding it.

The secondary core 2 is a laminated member consisting of a plurality of core plates made by punching a grain oriented silicon steel plate into a T shape. In a plan view, each of the core plates, as shown in FIG. 3, has a first joint portion *2b* at one end in the longitudinal direction of the core main portion *2a*. The length of the first joint portion *2b* is about three times larger than the width of the rectangular core main portion *2a*, and the first joint portion *2b* protrudes symetrically at right angles with the longitudinal direction of the care main portion *2a*. At the free peripheral edge portion of the first joint portion *2b* is formed a straight edge portion *2d* extending perpendicularly to the longitudinal direction of the core main portion *2a*. The length of the straight edge portion *2d* is nearly equal to that of a straight edge portion *3f* formed at the side portion *3a* of the primary core 3. The other end portion in the longitudinal direction of the main portion *2a* has a second joint portion *2c* which is so wide as to fit in the recess *3e* formed in the side portion *3b* of the primary core 3. The second joint portion *2c* is a little larger in width than the core main portion *2a* and the length of the second joint portion *2c* in the longitudinal direction of the main portion *2a* being a little larger than the depth of the recess *3e* formed in the side portion *3b* of the primary core 3. Thus when laminating the core plates, the secondary core 2 having the core main portion *2a* formed in a shape of beam is obtained. The core plate is the silicon steel plate punched from a grain oriented silicon steel sheet in which the longitudinal direction of the core main portion *2a* is coinsistent with the rolling direction of the silicon steel sheet.

The primary bobbin 11 made of a synthetic resin material is formed on the outer peripheral surface of the secondary core 2 except the end face area of the both joint portions *2b* and *2c* facing the primary core 3, that is, the lamination plane of the core plate in the straight edge portion *2d* in the first joint portion *2b* and the lamination plane of the core plate in a portion fitting in the recess *3e* of the primary core 3 in the second joint portion *2c*.

Figure 4:
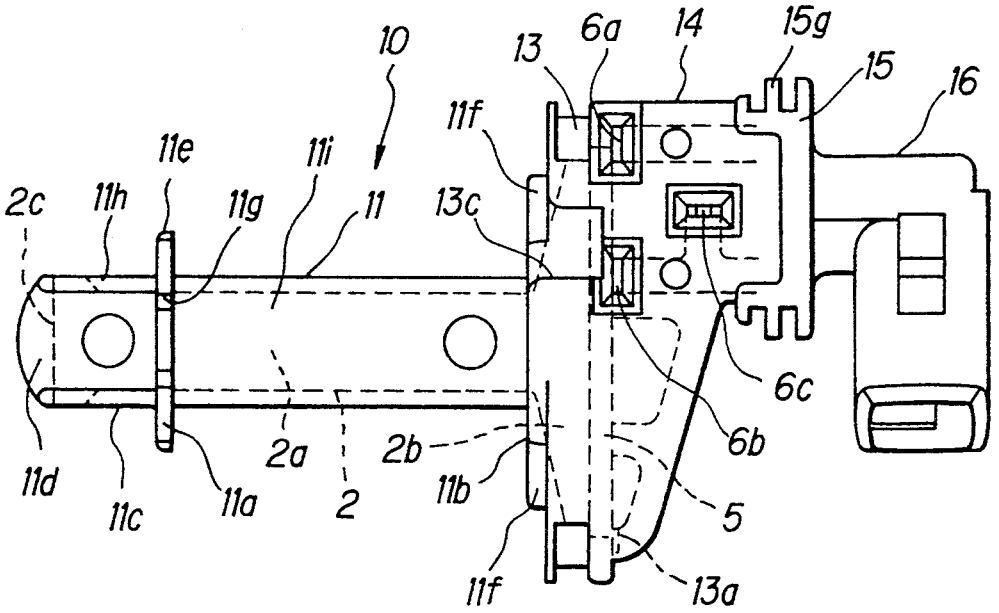
FIG. 4 is a plan view showing the state of a primary winding assembly before winding the primary winding in the aforesaid embodiment.
Figure 5:
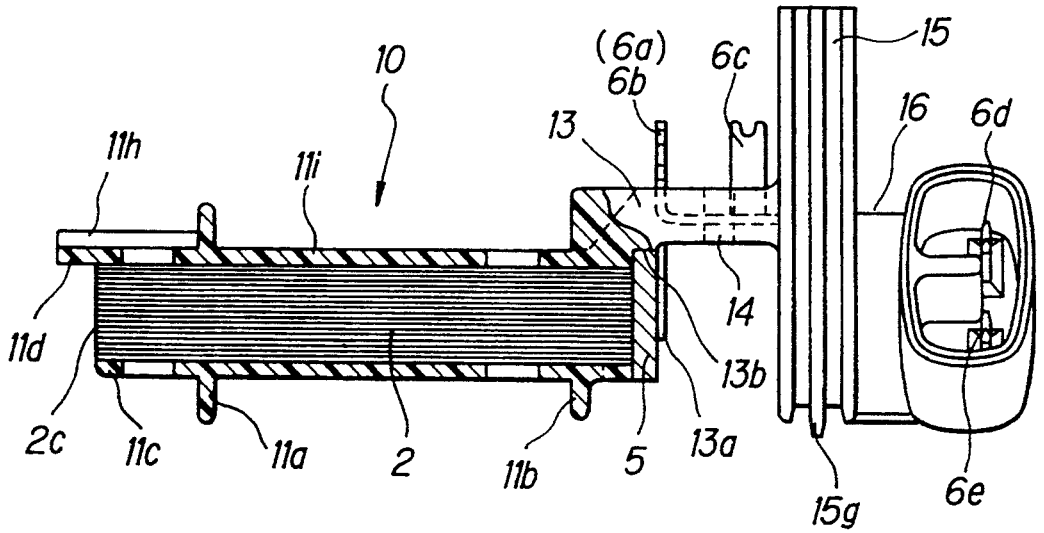
FIG. 5 is a front view, partly in section, of the primary winding assembly shown in FIG. 4.
Figure 6:
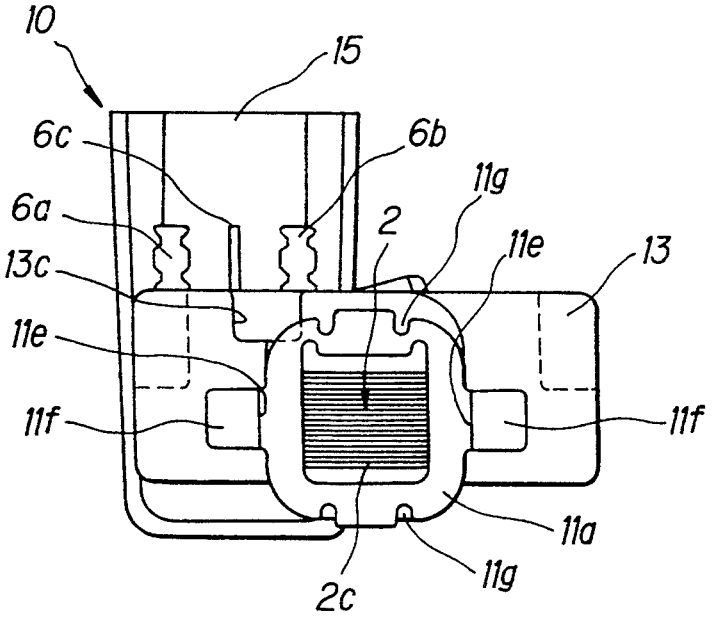
FIG. 6 is a side view of the primary winding assembly shown in FIG. 4.

The primary bobbin 11, as shown in FIGS. 4 to 6, includes a bobbin main portion 11*i* covering the side peripheral surface of the core main portion *2a* of the secondary core 2 and a supporting portion 13 covering the peripheral side peripheral surface of the first joint portion *2b* except the straight edge portion *2d*. The bobbin main portion 11*i* is molded in equal thickness over the overall length of the core main portion *2a* on the side peripheral surface of the core main portion *2a* of the secondary core 2 formed in the shape of beam. At the end section of the bobbin main portion 11*i* on the first joint portion *2b* side of the secondary core 2, a pair of flanges 11*b*, 11*b* of a predetermined height are protrusively provided within a plane perpendicular to the longitudinal direction of the straightedge portion *2d* of the first joint portion *2b* and perpendicular to the longitudinal direction of the core main portion *2a* of the secondary core 2, and furthermore a pair of engagement projections 11*f*, 11*f* are protrusively provided on the supporting portion 13 along the longitudinal direction of the straight edge portion *2d* of the first joint portion *2b* so as to be within the same plane as the flanges 11*b*, 11*b*. Also at the end section of the bobbin main portion 11*i* at a position on the second joint portion *2c* side of the secondary core 2, a flange 11*a* of the same level as the flange 11*b* is provided in parallel with the flange 11*b*, On the peripheral side surface of the main bobbin portion 11*i* a little apart from the end face of the second joint portion *2c*. These flanges 11*a* and 11*b* are used in determining the positions of the primary winding 12 and the secondary winding assembly 20.

On the supporting portion 13 covering the peripheral side surface of the first joint portion *2b* of the secondary core 2, lockpieces 13*a*, 13*a* for locking a permanent magnet 5 which contacts the lamination plane of the core plate forming the straight edge portion *2d* of the first joint portion *2b* are protrusively formed, corresponding to the overall length in their direction of width of the first joint portion *2b*, in positions corresponding to both end portions in the longitudinal direction of the first joint portion *2b*. The permanent magnet 5 is so magnetized that its face contacting with the lamination plane of the core plates of the first joint portion *2b* of the secondary core 2 and the reverse face thereto become poles having different polarities. The permanent magnet 5, as shown in FIG. 3, is inserted between the lamination plane of the core plate at the straight edge portion *3f* formed on the side portion *3a* of the primary core 3 and the lamination plane of the core plate at the straight edge portion 2*d* formed on the first joint portion 2*b* of the secondary core 2. The permanent magnet 5 has a shape of a square plate having the length of the long side is a little longer than the length in the longitudinal direction of the straight edge portion 2*d* formed on the first joint portion 2*b* of the secondary core 2 as shown in FIG. 3, and the length of the short side 52 as shown in FIGS. 1 and 5, is a little longer than the width of the first joint portion 2*b*. This permanent magnet 5 is held by the supporting portion 13 with its short side 52 locked by the lock pieces 13*a*, 13*a* of the supporting portion 13, and with one of its long sides engaged with an engaging groove 13*b* formed in the supporting portion 13 along one side edge of the straight edge portion 2*d*, in the longitudinal direction of thereof of the first joint portion 2*b* of the secondary core 2.

On the primary bobbin 11, a connecting portion 14 formed in a shape of a plate is integrally connected to one side edge portion of the supporting portion 13 along the longitudinal direction of the first joint portion 2*b* of the secondary core 2. The connecting portion 14 is connected on the edge portion of the supporting portion 13 in which the engaging groove 13*b* is formed, and is extending in parallel with the longitudinal direction of the core main portion 2*a* of the secondary core 2. That is, the connecting portion 14, as shown in FIG. 1, is connected protrusively in a position offset from the bobbin main portion 11*i* of the primary bobbin 11 such that the inner side surface of the connecting portion 14 might be positioned on the upper surface of the primary core 3 when the secondary core 2 is placed inside of the primary core 3 in the same plane as the primary core 3.

Figure 7:
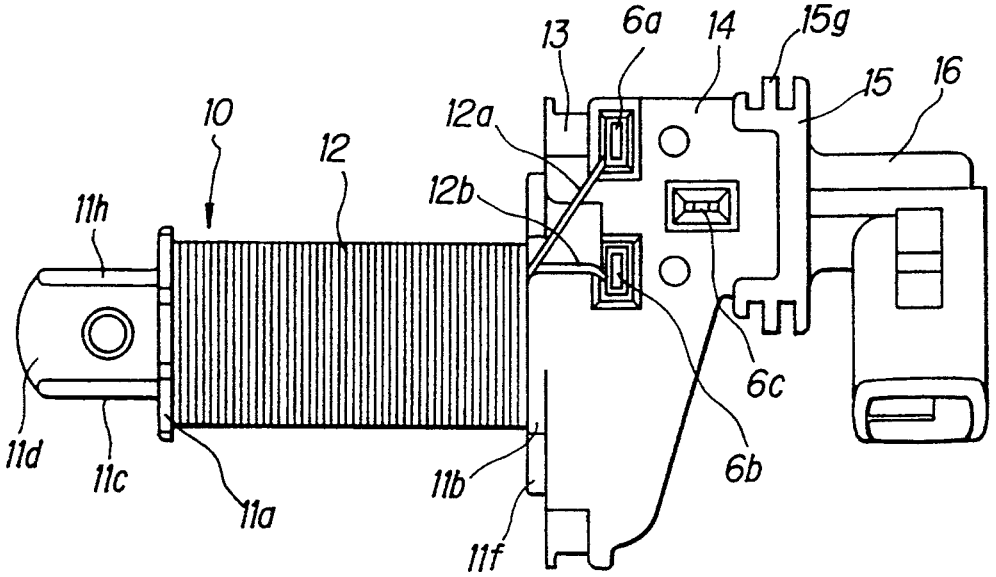
FIG. 7 is a plan view of the primary winding assembly in the aforesaid embodiment.
Figure 8:
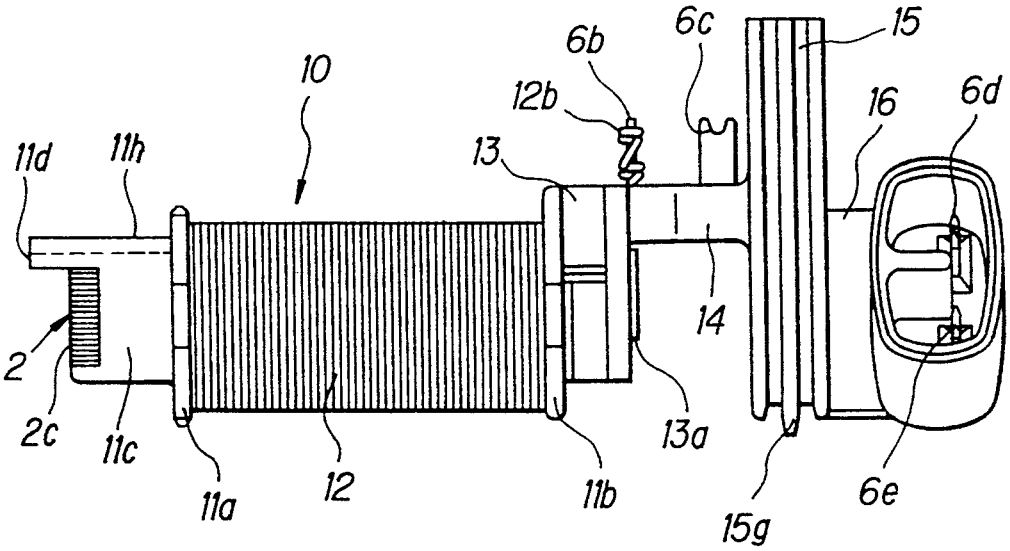
FIG. 8 is a front view of the primary winding assembly shown in FIG. 7.
Figure 9:
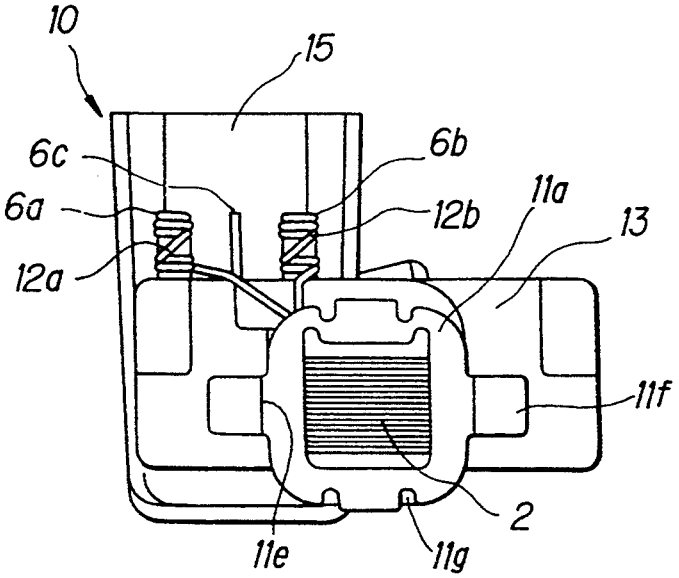
FIG. 9 is a side view of the primary winding assembly shown in FIG. 7.

On the outer peripheral surface of the bobbin main portion 11*i* of the primary bobbin 11 between the flanges 11*a* and 11*b* is wound a coated wire in two or four layers to fabricate the primary winding 12; the both end portions 12*a* and 12*b* of the coated wire is inserted through inside a cutout 13*c* formed in the supporting portion 13, and electrically connected to first and second terminals 6*b* and 6*a* which are protrusively provided on the outer side surface of the supporting portion 13 or the connecting portion 14, thereby constituting the primary winding assembly 10 as shown in FIGS. 7 to 9. The bobbin main portion 11*i* of the primary bobbin 11 has an extended portion 11*c* extending from the flange 11*a* toward the second joint portion 2*c* of the secondary core 2 on the side on which the connecting portion 14 protrudes. In this extended portion 11*c* is formed ribs 11*h* formed on both side edges and an extended piece 11*d*. The extended piece 11*d* is arc-shaped at the free end portion, which protrudes from the free end portion of the second joint portion 2*c* of the core 2. On the outer peripheral edge of the flange 11*a* are formed an engaging edge 11*e* and a cutout 11*g*. The primary bobbin 11 having the above-mentioned shape is molded out of an insulating synthetic resin, integral with the connecting portion 14 by insert molding process and the secondary core 2 is fixed in the primary bobbin 11 at the time of insert molding. In the illustrated embodiment, a rectangular closing member 15 for closing a third opening portion 32 formed in the casing 30 and a connector member 16 protruding from the outer wall of the closing member 15 are molded integral with the primary bobbin 11 and the connecting portion 14, at the free end of the connecting portion 14.

The secondary winding assembly 20, as shown in FIGS. 1 to 3, has the secondary winding 22 wound on the outer peripheral surface of the bobbin main portion 21*i* having a shape of a hollow cylinder of the secondary bobbin 21. On the outer peripheral surface of the bobbin main portion 21*i* are provided with a plurality of flanges 21*a* and 21*d* extending into planes perpendicular to the axis of the bobbin main portion 21*i*, respectively, protruding nearly at an equal spacing in the axial direction of the aforesaid axis. In grooves 21*b* formed between these flanges is wound the secondary windings 22. Flanges 21*d*, 21*d* formed on both end portions in the axial direction of the secondary bobbin 21 are wide flanges which are larger in width than other flanges. On the axially outside end face of the flange 21*d* which is located at one end of the secondary bobbin 21 are formed engaging recesses 21*g*, 21*g* for engaging with the engaging projections 11*f*, 11*f* on the primary bobbin 11. The inner peripheral surface of the bobbin main portion 21*i* of the secondary bobbin 21 has nearly the same sectional form as the outer peripheral edge of the flange 11*a* protruding from the bobbin main portion 11*i* of the primary bobbin 11. Therefore, when the bobbin main portion 11*i* of the primary bobbin 11 is inserted into the hollow portion of the bobbin main portion 21*i* of the secondary bobbin 21 with the outer peripheral edge of the flange 11*a* being engaged with the inner peripheral surface of the bobbin main portion 21*i* and the engaging projections 11*f*, 11*f* protruding on the primary bobbin 11 are engaged in the engaging recesses 21*g*, 21*g*, the secondary bobbin 21 and the primary bobbin 11 are assembled on the same axis with each other. At this time, the engaging edge 11*e* formed on the outer peripheral edge of the flange 11*a* of the bobbin main portion 11*i* of the primary bobbin 11 rides over a projection 21*h* protruding from the inner peripheral surface of the bobbin main portion 21*i* of the secondary bobbin 21 (FIG. 3), thereby preventing the fall of the primary bobbin 11 from the secondary bobbin 21.

On said wide flange 21*d* located on one end in the axial direction of the secondary bobbin 21 is formed a projection 21*c* protruding in parallel with the axial direction of the secondary bobbin 21. A terminal member 23*a* (an auxiliary terminal) made of a conductive material is protrusively fixed on the projection 23*c* in the same direction therewith. Also, on the other wide flange 21*d* formed in the vicinity of the axially other end of the secondary bobbin 21 is formed a projection 21*e* in a radial direction of the secondary bobbin 21. A terminal member 23*b* made of a conductive material is protrusively fixed on the projection 21*e* in the radial direction of the secondary bobbin 21. The coated wire forming the secondary winding 22 is electrically connected at the starting end thereof to the terminal member 23*a*, and is wound in order in the grooves 21*b* of the secondary bobbin 21, starting from one grove 21*b* located at the terminal member 23*a* side, then the coated wire is admired into next groove 21*b* through a cut-out 21*j* formed on the outer periphery of the flange 21*a* or 21*d*, and finally the terminal end of the coated wire is electrically connected with the terminal member 23*b*. On the latter terminal member 23*b* is electrically connected with a long conductive lead member 23*c* made of a conductive material, which is extended in the radial direction of the secondary bobbin 21.

On the outer periphery of the bobbin main portion 11*i* of the primary bobbin 11 is wound with the primary winding 12. Both ends of the coated wire constituting this primary winding 12 are electrically connected to the first and second terminals 8*b* and 8*a* to complete the primary winding assembly 10. Then, the permanent magnet 5 is installed to the supporting portion 13 of the primary bobbin 11. In the meantime, the secondary winding 22 is wound on the outer periphery of the bobbin main portion 21*i* of the secondary bobbin 21; and both ends of the coated wire constituting the secondary winding 22 are electrically connected to the terminal members 23*a* and 23*b*, thus completing the secondary winding assembly 20. Then, the bobbin main portion 11*i* of the primary bobbin 11 is axially inserted into the hollow section of the bobbin main portion 21i of the secondary bobbin 21 of the secondary winding assembly 20, and the primary winding assembly 10 and the secondary winding assembly 20 are installed with the engaging projections 11*f*, 11*f* protruding on the bobbin main portion 11*i* engaged in the engaging recesses 21*g*, 21*g* formed in the secondary bobbin 21. Subsequently, leads 8*a* and 8*b* of a diode 8 are electrically connected to a terminal 6*c* (an auxiliary first terminal) which is made of a conductive material and is protrusively fixed on the outer surface of the supporting portion 13 of the primary bobbin 11 of the primary winding assembly 10 or on the outer surface of the connecting portion 14 integrally connected to the supporting portion 13, and to the terminal member 23*a* (the auxiliary terminal) protrusively provided on the secondary bobbin 21 of the secondary winding assembly 20 (FIGS. 1 and 3).

The secondary winding assembly 20 mounted on the primary winding assembly 10, as shown in FIG. 10, is inserted into the internal space of the casing 30 through the first opening portion formed in the side wall 36 of the casing 30, and the secondary core 2 of the primary winding assembly 10 is positioned in the same plane as the primary core 3 which is fixedly installed in the casing 30 with the axis of the secondary bobbin 21 located on the axis of the semi-cylindrical bottom wall 37 of the casing 30. One surface of the permanent magnet 5 installed on the supporting portion 13 of the primary bobbin 11 of the primary winding assembly 10 meets the lamination plane of the core plate at the inside peripheral surface of the straight edge portion 3*f* of the side portion 3*a* of the primary core 3 fixed in the casing 30; and therefore the lamination plane of the core plates at the straight edge portion 3*f* of the primary core 3 faces the lamination plane of the core plates at the straight edges portion 2*d* of the first joint portion 2*b* of the secondary core 2 of the primary winding assembly 10 with the permanent magnet 5 located therebetween. In the meantime, the lamination plane of the core plates at the second joint portion 2*c* at the end of the secondary core 2 meets the lamination plane of the core plates in the recess 3*e* formed in the side portion 3*b* of the primary core 3. To facilitate the positioning of the second joint portion 2*c* of the secondary core 2 in the recess 3*e* of the primary core 3, an arc-shaped wall portion 40 for guiding the extended piece 11*d* is formed on the side wall 36 of the casing 30. The arc-shaped wall portion 40 is so formed that the arc-shaped free end of the extended piece 11*d* formed at the end of the extended portion 11*c* of the primary bobbin 11 is fitted to and guided along the wall portion 40. Furthermore, the extended piece 11*d* of the primary bobbin 11 is mounted on the upper surface of the side portion 3*b* of the primary core 3 which is secured by insert molding to the casing 30, and the connecting portion 14 connected offset to the bobbin main portion 11*i* of the primary bobbin 11 is mounted on the upper surface of the side portion 3*a* of the primary core 3, thereby ensuring the positioning of the secondary core 2 in the same plane as the primary core 3.

In the meantime, the lead member 23*c* which is conductive and radially extended from the secondary bobbin 21 of the secondary winding assembly 20 is inserted into the internal space of the secondary connector portion 31 of a cylindrical form protruding from the bottom wall 37 of the casing 30, and is electrically connected to a conductive terminal member 7 secured in the internal space of the secondary connector portion 31. The terminal member 7 is formed in a cylindrical shape and preferably fixed with the outer peripheral surface thereof on the inside wall surface of the secondary connector portion 31 of the casing 30, by insert molding at the time of molding the casing 30. The lead member 23*c* is inserted into a center hole 7*a* of the terminal member 7, and fixed on the terminal member 7 with solder 7*c*.

When a casing having no opening 32 in one wall of the side wall 36 is used as the casing 30, each of the terminals 6*a* (the second terminal), 6*b* and 6*c* (the first terminals) provided on the primary winding assembly 10 is formed to have a free end long enough to reach the first opening portion surrounded with the edge portion of the side wall 36 as indicated by a broken line in FIG. 1; a thermosetting synthetic resin, such as an expoxy resin, is charged in a fluid state of liquid into the internal space of the casing 30. The synthetic resin in a fluid state is filled in the internal space of the cylindrical secondary connector portion 31 protruding from the bottom wall 37 through the peripheral surface of the secondary winding assembly 20, and further enters the peripheral surface of the bobbin main portion 11*i* through the cutout 11*g* formed in the flange 11*a* formed on the bobbin main portion ill of the primary bobbin 11 of the primary winding assembly 10. Also the synthetic resin is filled in a clearance between the outer peripheral surface of the primary winding 12 and the inner peripheral surface of the secondary bobbin 21. Furthermore, the synthetic resin in fluid state is charged until the secondary bobbin 21 of the secondary winding assembly 20 is fully buried, and with the top ends of the terminals 6*a*, 6*b* and 6*c* left exposed above the surface of the filled synthetic resin. The synthetic resin thus filled is Cured and hardened to form a cured resin section 9 (see FIG. 3). In FIG. 1, a broken line with a reference numeral 9 indicates the surface of the cured resin section 9. The lamination plane of a core plates at the straight edge portion 3*f* of the side portion 3*a* of the primary core 3 and the lamination plane of a core plates at the straight edge portion 2*d* of the first joint portion 2*a* of the secondary core 2 are in contact with the both sides of the permanent magnet 5; therefore the synthetic resin in the fluid state fix the permanent magnet 5 in a specific position without entering between these two contact surfaces. Also since the lamination plane of the core plates at the end of the second joint portion 2*c* of the secondary core 2 is in contact with the lamination plane of the core in the recess 3*e* formed in the side portion 3*b* of the primary core 3, the synthetic resin in the fluid state may not fill this contact area.

The primary winding 12 and the secondary winding 22 are embedded to be fixed in the cured resin section 9 in the state that they are held in relative positions by filling the synthetic resin in fluid state in the casing 30 and curing and hardening the synthetic resin, thereby making an ignition coil which ensures insulation to a high voltage outputted from the secondary winding 22. In this ignition coil, the terminals 6*b* and 6*c* (the first terminals) are connected by cables to the positive terminal of a battery (not illustrated), and the terminal 6*a* (the second terminal) is connected by cable to a control circuit (not illustrated) termed an igniter of a ignition circuit which is driven by the battery. Also, the terminal member 7 fixed on the casing 30 is connected by a cable to a spark plug (not illustrated). It is noted that the permanent magnet 5 is present, the flux flows in a direction which is determined by the direction of magnetization of the permanent magnet 5 (for example the permanent magnet 5 is magnetized so that the surface in contact with the primary core 3 will be a negative pole) to thereby form a closed loop in the primary core 3 and the secondary core 2. When the primary current is supplied to the primary winding 12 through the terminal 6*c*, there is produced the voltage of 300 to 600 V at the primary winding 12, and the flux flows in the reverse direction of said flow which is derminated by the direction of magnetization of the permanent magnet 5 as previously stated. When the primary current is suddenly interrupted by the control circuit, there is induced a counter electromotive force at the secondary winding 22, thus producing a high voltage of 30 to 40 kV. This high voltage is applied to the spark plug through the terminal 23*b*, the lead member 23*c*, the terminal member 7, and the cable connected to the terminal member 7, thereby generating a spark between the center electrode and ground electrode of the spark plug.

The diode 8 connected across the terminals 6*c* and the terminal 23*b* serves to prevent the occurrence of an electric spark at the spark plug when supplied with the voltage of 1 to 3 kV generated at the time of supply of the primary current to the primary winding 12. The permanent magnet 5 is preferably produced of a rare earth magnet consisting of a sintered body of samarium cobalt (Sm-Co) metal which has great residual magnetic flux density to domagnetize. For example, there is used a rare earth magnet which may not be demagnetized until the magnetic flux density in the opposite direction during the supply of the primary current to the primary winding 12 reaches 0.7 T (tesla) in ordinary operation at the magnetic flux density of 0.8 T (tesla) and at a temperature of 150° C.

By interposing the permanent magnet 5 between the primary core 3 and the secondary core 2 the effective magnetic flux at the ignition coil can be largely increased. Therefore, the magnetic flux density formed in the primary winding 12 can be increased and at the same time the magnetic flux produced at the secondary winding 22 can be largely increased, in relation to the electromotive force generated by the supply of the primary current, thereby enabling increasing the output voltage of the secondary winding 22 and the discharge energy.

In the embodiment shown in the drawings, a third opening portion 32 having a shape of rectangle and an opening in the upper surface is formed in one side face of the side wall 36 of the casing 30 as shown in FIGS. 1 to 3. Meanwhile, as shown in FIGS. 4 to 9, in the primary bobbin 11 of the primary winding assembly 10, the closing member 15 having a shape of a rectangle for closing the third opening portion 32 and the connector member 16 protruding on the outside wall of the closing member 15 are formed integral with the bobbin main portion 11*i*. In the present embodiment, when an assembled body of the primary winding assembly 10 and the secondary winding assembly 20 is inserted into the casing 30 through the first opening portion formed in the upper surface of the side wall 36 of the casing 30, the arc-shaped free end of the extended piece 11*d* formed on the primary bobbin 11 is fitted and guided on the arc-shaped wall portion 40 formed on the side wall 36 of the casing 30 as described above, and, at the same time, engaging projections 15*g* formed on both side edges of the closing member 15 is engaged and guided in engaging groove 32*g* formed in both side edges of the third opening portion 32 formed in the side wall 36, thereby ensuring that the closing member 15 may fully close the third opening portion 32 formed in the side wall 36 and properly position the primary bobbin 11 in a specific position.

In the connector member 16 is formed a concave portion for receiving a connecting portion of the cable extending from the ignition circuit of the internal combustion engine. In this concave portion are protrusivety fixed conductive terminals 6*d* and 6*e*. The terminal 6*d* (a third terminal) is electrically connected with terminals 6*b* and 6*c* (the first terminal and the auxiliary first terminal) protrusively provided on the connecting portion 14 or the supporting portion 13, through a conductor plate embedded in the closing member 15 and the connecting member 14 to form one and single first terminal. The terminal 6*e* is electrically connected with a terminal 6*a* protrusively provided on the connecting member 14 or the supporting member 13, through a conductor plate embedded in the connector member 16, the closing member 15 and the connecting member 14 to form a single second terminal. It is preferable that each set of the terminals 6*d*, 6*b* and 6*c* and the terminals 6*e* and 6*a* which is electrically connected is integrally formed of a conductive metal plate, and the conductive metal plate is fixed by embedding by the insert resin molding in the connecting member 14, the closing member 15 and the connector member 16 at the time of molding of the primary bobbin 11. In this case, the primary winding 12 and the secondary winding 22 are connected with the ignition circuit of the internal combustion engine through the first and second terminals 6*d* and 6*e* which are fixed protrusively in the connector member 16; therefore the cured resin section 9 formed of synthetic resin filled in the casing 30 is so formed as to entirely bury the terminals 6*a*, 6*b* and 6*c*. In FIGS. 1 to 3, a reference numeral 33 denotes a projecting portion formed integral with the casing 30, on the outside of the enlarged side wall portion 38 of the casing 30. In this projecting portion 33 is embedded with a metal collar 34 by insert resin molding. In this metal collar 34 is rotatably supported a bolt 35 with a washer installed. At the bottom surface of the projecting portion 33 and the metal collar 34 is formed flat as shown in FIG. 1; the projecting portion 33 is mounted on the upper surface of auxiliary equipment base of the internal combustion engine or an engine mount for mounting the internal combustion engine on the vehicle body, and secured to the base or mount by the bolt 35.

What is claimed is:

1. An ignition coil for internal combustion engines, comprising:

a casing molded of an insulating synthetic resin having a bottom wall with a step portion formed on the inside wall surface fixing a primary core, a side wall formed in a cylindrical shape surrounding said bottom wall, and a first opening portion surrounded with a free edge of said side wall;

said primary core secured on said step portion formed on said bottom wall of said casing;

a primary winding assembly including: a secondary core contacting said primary core at its both end face portions to form a closed magnetic circuit together with said primary core; a primary bobbin having a bobbin main portion formed cylindrical of an insulating synthetic resin surrounding the outer peripheral surface of a main portion of said secondary core, and at least one extended connecting portion extended from said bobbin main portion in a position offset in relation to said bobbin main portion, and extended to the upper surface of said primary core, for positioning said end face portion of said secondary core in relation to said primary core; and a primary winding with both ends of insulated wire constituting said winding electrically connected to first and second conductive terminals protrusively installed on said bobbin main portion;

a secondary winding assembly including: a secondary bobbin formed cylindrical of an insulating synthetic resin, surrounding the outer periphery of said primary winding of said primary winding assembly; and a secondary winding wound on the outer peripheral surface of said secondary bobbin, with one end of an insulated wire constituting said winding electrically connected to said first terminal protrusively provided on said primary bobbin and with the other end of said insulated wire electrically connected to a conductive lead member protrusively provided on said secondary bobbin in a direction perpendicular to the axial direction of said secondary bobbin; and a conductive terminal member for closing a second opening portion formed in a part of a bottom wall of said casing, said terminal member being fixed with the peripheral surface thereof on the inside wall of said second opening portion and electrically connected with said lead member protruding from said secondary bobbin of said secondary winding assembly;

whereby, said terminal member is to be connected to said spark plug of said internal combustion engine, said first terminal is to be connected to a power source battery of an electric circuit for ignition for said spark plug, and said second terminal is to be connected to a control circuit of said electric circuit for ignition.

2. An ignition coil for internal combustion engines as claimed in claim 1, wherein said primary core is formed in a shape of rectangular ring in a plan view; said core main portion of said secondary core surrounded by a cylindrically molded bobbin main portion of said primary bobbin is formed in a shape of straight beam; a permanent magnet formed in a shape of a plate is supported on said supporting portion constituting one end portion of said bobbin main portion; and one face of said permanent magnet magnetized at one magnetic pole is in contact with one of said end face portions of said secondary core, while the other face of said permanent magnet magnetized at the other magnetic pole is in contact with an inside peripheral surface of said primary core.

3. An ignition coil for internal combustion engines as claimed in claim 2, wherein said primary core is fixed to said casing by insert resin molding, and said secondary core is fixed to said primary bobbin of said primary core assembly by the insert resin-molding.

4. An ignition coil for internal combustion engines as claimed in claim 3, wherein at least said primary winding assembly and said secondary winding assembly are embedded in an insulating synthetic resin portion filled and cured in said casing, thereby being fixed in said casing.

5. An ignition coil for internal combustion engines as claimed in claim 2, wherein said casing has a third opening portion formed in a portion of said side wall and opening at the free edge of said side wall; said primary winding assembly has a closing member formed integrally with said extended connecting portion of said primary bobbin, said closing member is so formed as to close said third opening portion of said casing; a connector portion having a third and a fourth conductive terminals protruding on the outside surface thereof is integrally formed on the outer surface of said closing member; and said third terminal being electrically connected to said first terminal protruding on said primary bobbin, said fourth terminal being electrically connected to said second terminal protruding on said primary bobbin, by electrically conductive conductors embedded in said connecting portion, said closing member and said connector member, respectively, whereby said third terminal is to be connected to said battery and said fourth terminal is to be connected to said control circuit, respectively.

6. An ignition coil for internal combustion engines as claimed in claim 5, wherein said primary core is fixed to said casing by insert resin molding, and said secondary core is fixed by insert resin molding to said primary bobbin of said primary core assembly.

7. An ignition coil for internal combustion engines as claimed in claim 6, wherein at least said primary winding assembly, said secondary winding assembly, and said permanent magnet are embedded in an insulating synthetic resin portion filled and cured in said casing, thereby being fixed to said casing.

* * * * *